United States Patent [19]

Cannell et al.

[11] 3,970,136

[45] July 20, 1976

[54] METHOD OF MANUFACTURING COMPOSITE MATERIALS

[75] Inventors: John Corjeag Cannell, Waltham Abbey; Rodney Seymour Leaper, Hoddesdon; Noel James Parratt, Loughton, all of England

[73] Assignee: The Secretary of State for Defence in Her Britannic Majesty's Government of the United Kingdom of Great Britain and Northern Ireland, London, England

[22] Filed: Mar. 14, 1975

[21] Appl. No.: 558,475

Related U.S. Application Data

[63] Continuation of Ser. No. 231,594, March 3, 1972, abandoned.

[30] Foreign Application Priority Data

Mar. 5, 1971 United Kingdom ..... 6093/71

[52] U.S. Cl. ..... 164/108; 29/191.4; 164/112

[51] Int. Cl.[2] ..... B22D 19/02

[58] Field of Search ..... 164/108–112, 164/80, 97; 29/191.4, 195

[56] References Cited

UNITED STATES PATENTS

| | | | |
|---|---|---|---|
| 2,932,071 | 4/1960 | Whitehurst | 164/97 X |
| 3,138,837 | 6/1964 | Weeton et al. | 164/97 |
| 3,187,422 | 6/1965 | Morgan | 29/419 R |
| 3,547,180 | 12/1970 | Cochran et al. | 164/97 X |
| 3,676,293 | 7/1972 | Gruber | 29/191.4 X |

*Primary Examiner*—Ronald J. Shore
*Assistant Examiner*—Gus T. Hampilos
*Attorney, Agent, or Firm*—Stevens, Davis, Miller & Mosher

[57] ABSTRACT

A process for forming a composite material comprising a metal matrix incorporating fibrous reinforcement having a pre-determined pattern of fibre orientation which includes the steps of providing in a mould substantially parallel fibre arrays in which each array consists of a sheet of substantially coplanar fibres, providing a reservoir of molten matrix metal between at least some of the fibre arrays and applying pressure to the mould contents sufficient to force molten metal to surround substantially all the fibres.

22 Claims, 12 Drawing Figures

METHOD OF MANUFACTURING COMPOSITE MATERIALS

This is a continuation of application Ser. No. 231,594, filed Mar. 3, 1972, now abandoned.

The invention relates to improvements in the manufacture of composite materials comprising a metal matrix incorporating particulate reinforcing material, particularly strong refractory materials in fibre form such as whiskers of silicon carbide and silicon nitride and fibres of asbestos and carbon.

U.S. Pat. No. 3,695,335 describes the manufacture of metal composites by processes in which a defined pressure programme is applied to an admixture of molten metal and particulate reinforcing material in a mould in which the desired pressures are maintained by arranging heat sinks adjacent potential leakage paths from the mould so that the mould becomes in effect self-sealing. Composite materials obtained from these processes were found to possess the theoretical density predicted for a mixture of the components of the composite and to possess after extrusion good values of strength and stiffness compared with unreinforced metal matrix materials. However, the composite materials described in U.S. Pat. No. 3,695,335 are considerably less strong and stiff than might reasonably be predicted because of the difficulty of introducing high volume loadings of refractory fibres and the breakage of fibres incorporated into the composite when the as-cast composite billet is extruded to optimise composite properties by aligning some reinforcing fibres in the direction of extrusion.

The present invention aims to provide metal composite materials in which high loadings of up to about 50% by volume of reinforcing refractory fibre is incorporated in the composite and in which the as-cast composite has a high degree of fibre alignment in pre-determined directions.

According to the present invention, a process for forming a composite material comprising a metal matrix incorporating fibrous reinforcement having a predetermined pattern of fibre orientation includes the steps of providing in a mould a plurality of layers of fibres formed from at least one array of coplanar fibres, providing reservoirs of molten matrix metal between at least some of the layers of fibres and applying pressure to the mould contents sufficient to force molten metal to surround substantially all the fibres. The fibres arrays used to form the layers of fibres in accordance with the present invention may be conventional fibre mats or felts as used in composite production. The plurality of layers may be formed from a plurality of arrays each forming one layer or from a single array, or small number of arrays, for example by folding. The disposition of the fibre arrays prior to the application of pressure to the mould contents is chosen to give the pre-determined pattern of fibre orientation in the resulting composite. The coplanar fibres in the fibre array may be unidirectionally aligned, aligned in more than one chosen direction, or randomly aligned within the plane of the array.

The present invention overcomes the problems found in providing a pre-determined pattern of oriented reinforcing fibre in a mould and forcing a charge of molten matrix metal through the fibres to give a composite. The problems were found principally to be that molten matrix metal could penetrate only a certain distance into a mass of oriented reinforcing fibre before solidifying and that continued pressure thereafter served only to damage and break the unpenetrated fibres; and also that the advancing charge of molten matrix metal tended to tightly compress the oriented fibre so that it was extremely difficult to penetrate. The present invention derives from our realisation that a reservoir of molten matrix metal must be provided at a sufficient number of positions within a mass of oriented reinforcing fibre to ensure that the maximum distance between neighbouring reservoirs did not exceed twice the distance which the molten metal could penetrate before solidification at the particular temperatures and pressures used. Additionally, it was appreciated that the maximum volume of fibre was likely to be incorporated into the composite if relatively dense sheets of aligned, and therefore well-packed, reinforcing fibres were arranged substantially to each other with passageways between at least some of the sheets which could be filled with molten matrix metal to provide reservoirs with the necessary minimum separation from each other.

Processes in accordance with the present invention can be carried out in a variety of ways by using various combinations of fibre arrays and molten metal reservoirs and some typical processes are described with reference to the accompanying drawings in which.

Figure 5:
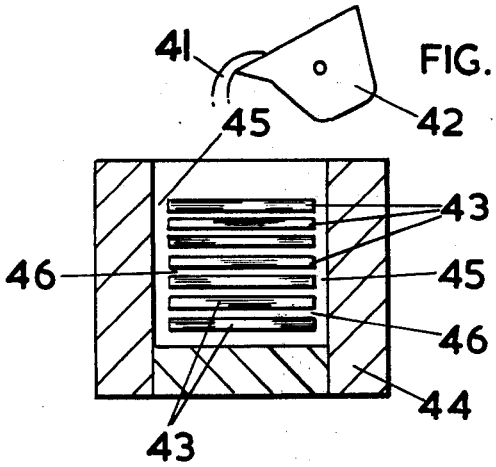
Figure 6A:
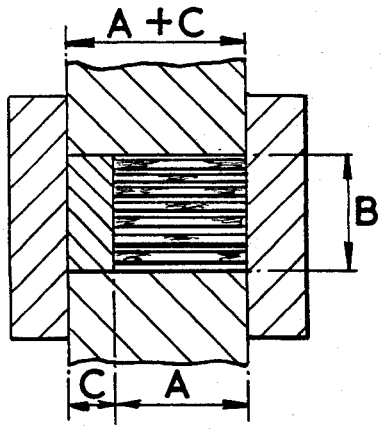
Figure 6B:
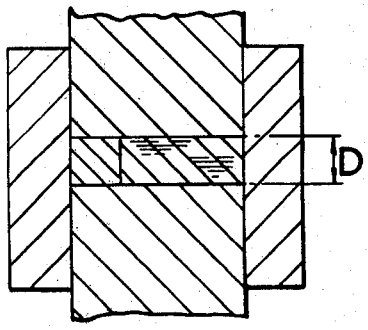
Figure 7:
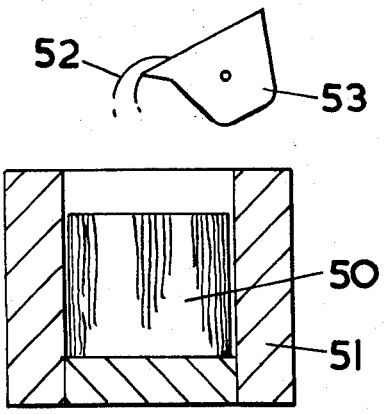
Figure 8:
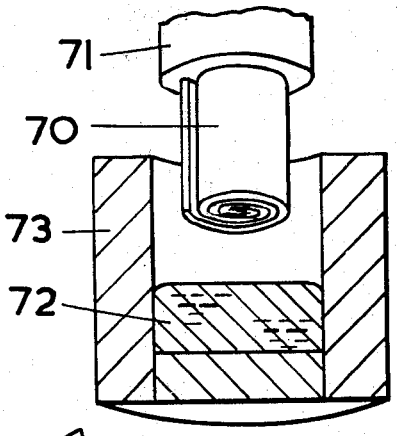
Figure 9:
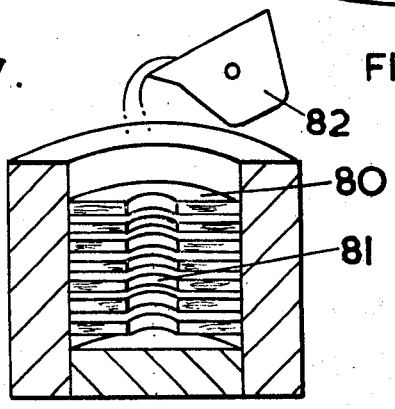
Figure 10:
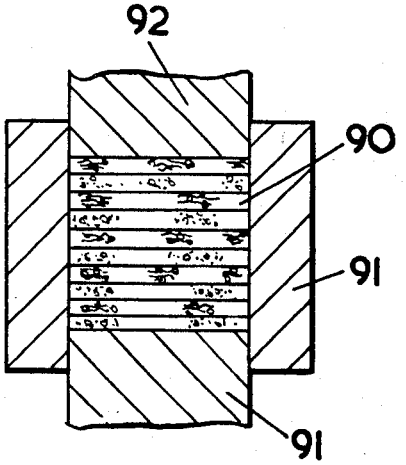

FIGS. 5, 6*a* and 6*b* illustrate processes wherein molten metal is added to fibre arrays;

FIG. 7 illustrates a similar process for the production of cylindrical components;

FIG. 8 illustrates a process wherein fibres are introduced into a mould already containing the molten metal;

FIG. 9 illustrates a process similar to that of FIG. 5 for producing cylindrical composites having reinforcement in the region of the longitudinal axis; and FIG. 10 illustrates the use of fibre arrays containing metal particles.

Figure 10A:
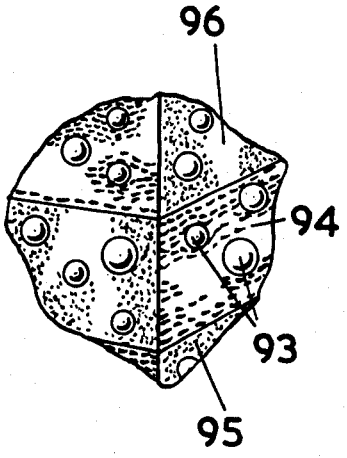

FIG. 10*a* illustrates a stack of alligned fibre-arrays in which matrix metal particles are dispersed within an array.

Figure 1:
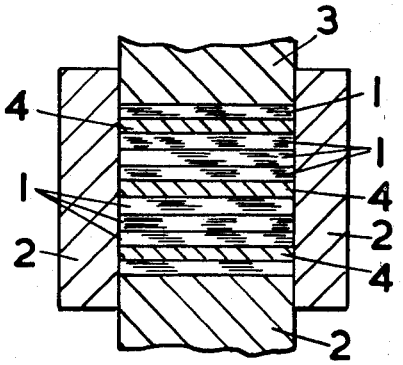
FIG. 1 illustrates a process using horizontal fibre arrays and metal sheets.
Figure 2:
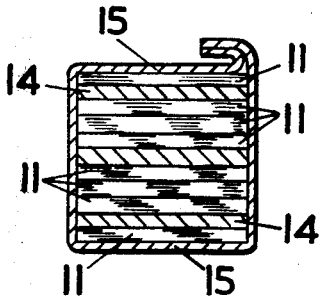
FIGS. 2 and 3 illustrate a modification of the process of FIG. 1 wherein the fibre arrays and metal sheets are enclosed in a thin walled envelope.

In one embodiment illustrated diagrammatically in FIG. 1 a stack of parallel planar fibre arrays 1 is provided in a mould 2 substantially normal to the direction of the pressure to be applied to the mould by a piston 3 and sheets of solid matrix metal 4 are interposed between at least some of the fibre arrays with a separation between neighbouring matrix metal sheets of not more than twice the distance which the matrix metal when molten can penetrate before solidification under the chosen conditions of temperature and pressure. In this embodiment, the stack of fibre arrays and matrix metal sheets is heated in the mould until the matrix metal is molten and pressure is applied by the piston 3 to the stack to completely infiltrate the reinforcing fibres. In a modification of this embodiment illustrated in FIG. 2, the stack of fibre arrays 11 and matrix metal sheets 14 are prepared outside the mould and for convenience enclosed within a thin walled container 15 of a material which does not melt at the temperatures to which the matrix metal is to be heated. The enclosed stack of fibre arrays and matrix metal sheets is then heated to melt the matrix metal and the resulting enclosed admixture of reinforcement and molten metal is introduced into the mould and subjected to pressure as before. It is important to note that the thin-walled container serves merely to prevent leakage of molten metal from the stack during heating and transfer to the mould and that it is not intended that the container be sufficiently robust or suitably sealed so as to act as a deformable membrane capable of transmitting isostatic pressure to the molten metal contained within the container. Pressure in the mould is effectively applied direct to the admixture of fibre arrays and molten metal in the mould.

Figure 3:
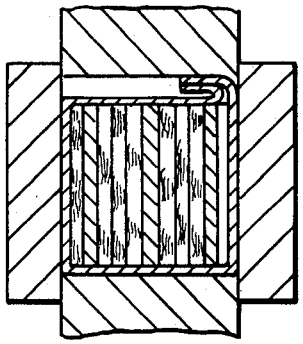
Figure 4:
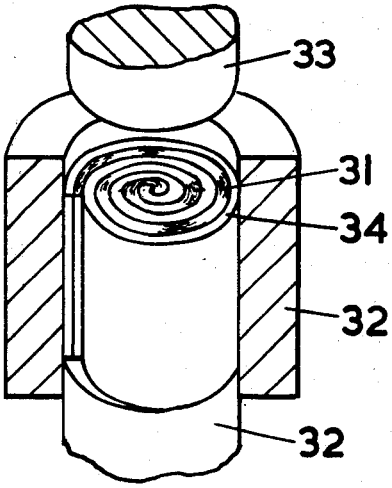
FIG. 4 illustrates a similar process for the production of cylindrical composites.

In the foregoing embodiments it will be appreciated that as the fibre arrays are aligned in the mould normal to the direction of approach of the mould closure the resulting composite will have its major reinforcement normal to the direction of applied pressure. This is extremely satisfactory where the mould is a relatively wide shallow shape designed to give sheet, disc or strip composite mouldings. However, where a composite is required in the form of a bar or cylinder having its predetermined pattern of fibre orientation as major reinforcement longitudinally along the bar or cylinder, the foregoing embodiments are considerably less appropriate In accordance with a further feature of the present invention, therefore, fibre arrays are arranged in the mould parallel to the direction of approach of the mould closure to the mould. This arrangement may take the form of a stack of fibre arrays and matrix metal sheets identical to those described in the foregoing embodiments, except that the plane of the fibre arrays is arranged parallel to the direction of approach of the mould closure as illustrated in FIG. 3. However as illustrated in FIG. 4, a preferred construction especially for the manufacture of cylindrical billets with reinforcement extending longitudinally, is to provide in a mould 32 a fibre array in the form of a rolled sheet 31 of aligned fibres in which the longitudinal axis of the roll is parallel to the direction of approach of the mould closure 33. One or more sheets of matrix metal 34 are conveniently interposed within the rolled up sheet of aligned fibres 31 to form reservoirs of molten metal when heated, having a separation between neighbouring reservoirs not greater than twice the penetration distance of the molten metal under the desired applied pressure. It is to be understood that sheets of aligned fibres rolled up as described constitute layers of fibres as the term is meant in the present specification.

In all the foregoing embodiments the reservoirs of molten metal have been positioned appropriately within the pattern of aligned reinforcing fibres by first introducing the matrix metal in sheet form in the solid phase. It is clearly attractive for simplicity of operation, reduction in processing stages, and for economic operation, to feed molten metal directly to the reservoir positions within the aligned fibre pattern and thus provide the molten metal at the appropriate positions from which penetration of the fibres can take place. It will be appreciated that this procedure might well suffer from the deficiencies of the fibre mass/molten metal charge system that the present invention was designed to overcome, but we have found in accordance with an important aspect of the present invention that successful composites may be formed by ensuring that, during the application of pressure to an admixture of molten metal and aligned fibre arrays, the molten metal has paths between the fibre arrays so that the metal can flow to the necessary reservoir positions and from there penetrate the adjacent fibre arrays. It is essential to provide a path for the molten metal between the fibre arrays which is not closed at the onset of the applied pressure. This is readily achieved when the aligned fibre arrays are arranged parallel to the direction of approach of the mould closure as shown in FIGS. 3 and 4 since the approaching mould closure readily forces molten metal along the paths between the fibre arrays which are effectively presented edge-on. However, disadvantages which follow from this arrangement of fibre arrays include the facts that the fibre arrays are buckled and distorted by the applied moulding pressure and also that little useful compression of the fibre arrays occurs so that the fibre volume fraction in the resulting composite is not as high as may be desired. In accordance with another optional feature of the present invention, we have found that very satisfactory composites may be formed by pouring molten metal on to substantially parallel fibre arrays which are arranged in a mould transverse to the direction of approach of the mould closure provided that at least one path is provided for the molten metal to flow between the arrays and the side of the mould without first passing through the fibre arrays whereby a catchment of molten metal is formed in the mould from which molten metal may flow directly between the fibre arrays to the desired reservoir positions between the arrays and thence surround the fibres. In this way, moulding pressure first distributes the molten metal within the fibre arrays and then consolidates both fibres and metal to give composites with a high fibre loadings which can be in excess of 50% by volume. A typical embodiment is illustrated in FIG. 5 which shows a supply of molten metal 41 being poured from a crucible 42 on to a stack of parallel fibre arrays 43 arranged in a mould 44 transverse to the direction of approach of the mould closure piston (not shown). Pathways 45 (shown in exaggerated sizes of reduced flow resistance are formed between the fibre arrays and the mould sides and the molten metal is forced along these by pressure from the mould closure and thence to the reservoir positions such as 46 between the fibre arrays. The minimum quantities of molten metal required to completely infiltrate a parallel fibre array in this manner can be readily calculated with reference to FIG. 6 which shows at 6(a) a stack of fibre arrays before compression extending across the mould for a width A to leave a catchment volume for molten metal extending for a width C between the fibre arrays and the mould side. If the mould closure piston compresses the two components with a compression ratio of D/B then it can be shown that the required catchment volume fraction (C)/(A+C) should equal D/B less the ratio of the volume fraction occupied by the fibres in the composite to the total volume in the mould prior to compression. As a practical guide, therefore, since the last term is usually small the required catchment volume fraction between the fibre arrays and the mould side should approximate to the compression ratio needed to fully consolidate the composite.

Many modifications and variations of processes in accordance with the invention are apparent. For example, the fibre volume fraction of composits materials formed with the fibre arrays parallel to the direction of approach of the mould closure (such as described with reference to FIG. 4) may be improved by producing a pre-consolidated plug of aligned fibre arrays and pouring molten metal on to the plug. In practice, considerable pre-consolidation of the fibre arrays can be achieved without preventing the penetration of the molten metal to the reservoir positions. FIG. 7 illustrates a typical arrangement of a pre-consolidated rectangular plug 50 positioned within a mould 51 to receive a charge of molten metal from a concible 53 prior to the application of moulding pressure.

A further alternative embodiment is illustrated in FIG. 8 in which parallel fibre arrays in the form of a rolled sheet of fibres are attached to a mould closure piston 71 and forced into molten metal 72 contained within a mould 73.

In a further embodiment of the invention illustrated in FIG. 9, a stack of annular fibre arrays is arranged to form a cylinder in which the axial space 81 acts as a catchment volume for molten matrix metal poured from crucible 82. Pressure from a mould closure (not shown) forces the molten metal sideways between the annular fibre arrays and thence around the fibres in each array. The resulting composite has a core of matrix metal which can be readily drilled out to leave a hollow composite cylinder which can be extruded to give a tube of composite. It will be appreciated that excessive drill wear is avoided since abrasive refractory fibres do not need to contact the drill.

The fibre arrays necessary to form layers of fibres in accordance with the present invention are conveniently produced by the extrusion of a dispersion of fibres in a viscous liquid throught an aligning nozzle on to a relatively moving permeable surface as fully described in U.S. Pat. Nos. 3,695,335 and 3,617,437. Sheets of coplanar fibres produced in this way may have a high degree of alignment and such well aligned sheets assist greatly in obtaining high volume loadings of fibre in the composite materials produced by the present invention.

The non-metallic fibrous reinforcing materials which can be utilised by processes in accordance with the present invention are mainly those refractory materials which can be expected to offer improved properties in the composite compared with the matrix metal alone and include carbon and boron fibres in staple or semi-continuous form, glass, silica, and asbestos fibres and whiskers of silicon carbide, silicon nitride and alumina. Although the benefits of the present invention are greatest in the field of strong refractory fibre reinforcement, the invention also offers a rapid and convenient route to the formation of composites containing less sophisticated fibrous material.

In accordance with a further alternative embodiment of the invention, we have found that matrix metal may be provided in the solid phase in particulate form distributed between fibre arrays and occupying reservoir positions. The particulate matrix metal may then be heated in situ in the reservoir positions either prior to loading the matrix metal and fibre arrays into the mould or alternatively after loading into the mould. Most conveniently, the particulate matrix metal is dispersed within some or all of the coplanar fibre arrays during the manufacture of the arrays. Particulate metal is readily dispersed within the viscous dispersion media used in the processes described in U.S. Pat. No. 3,617,437 to provide a fibre array having particles of a desired matrix metal regularly dispersed within the array. In general, the particle size of the metal matrix particles should be large relative to the diameter of the fibres composing the fibre array and should normally exceed a mean size of 60 microns. The maximum mean particle size should not exceed the thickness of the individual parallel fibre arrays. The shape of the matrix metal particles is desirably equant so that the fibres in the array receive the minimum disturbance and can "drape" readily around the particles. Particularly convenient are substantially spherical particles such as those of atomised aluminium.

The matrix metal of the composites may be any metal which does not react with the selected reinforcing fibres during processes in accordance with the invention to an extent which neutralises the value of the reinforcement to be obtained. Typically matrix metals are aluminium, magnesium, titanium, copper, nickel, lead and tin and alloys containing one or more of these metals.

The preferred pressure programme required to produce composites in accordance with the invention from particular combinations of reinforcing fibre and matrix metal will generally need to be determined by experiment in each case utilising the principles more fully described in U.S. Pat. No. 3,695,335. Similarly, the type of mould used to produce composites by processes hereinbefore described is conveniently that described with reference to the drawings filed with U.S. Pat. No. 3,695,335.

Particular examples of the manufacture of composite materials in accordance with the invention will now be described.

EXAMPLE 1

A stack of aligned fibre arrays interleaved ith sheets of aluminium alloy foil (RR 58 — product of High Duty Alloys Ltd with a melting point of 630°c) was formed from sheets of aligned silicon carbide whiskers (having an aspect ratio of between 5:1 and 50:1) produced by the processes described in U.S. Pat. No. 3,695,335. The whisker layers had a weight per unit area of 0.1 $g.cm^{-2}$ and the aluminium foil a thickness of 0.6 mm. The stack was made up of one layer of whiskers at the top and bottom of the stack enclosing parallel alternate layers respectively made up of six adjacent layers of fibre and one of alloy. The stack was built up in this way to an overall thickness of 1.52 cm, enclosed in pure aluminium foil (melting point 667°C) and heated at 660°C. The heated stack was quickly transferred to a mould of the type described with reference to FIGS. 1–3 of the drawing accompanying U.S. Pat. No. 3,695,335 with the plane of the layers normal to the direction of approach of the mould closure piston. An encapsulating pressure programme of about 500 psi (pounds per square inch) for about 0.2 seconds followed by 2000 psi increasing to 3 tone per square inch was applied to reduce to stack to about 0.15 cm in height. The resulting composite contained 16% by volume of whiskers, was substantially void-free and of theoretical density, and had an ultimate tensile strength of 42 tons per square inch compared with a figure of 20 tons per square inch for an aluminium alloy (RR58) control as cast.

EXAMPLE 2

A stack of aligned fibre arrays was formed from felts of silicon carbide whiskers (having a mean aspect ratio of 50:1 and produced by the processes described in U.S. Pat. No. 3,965,335) each felt measuring 6cm by 4cm and having a weight per unit area of 0.1 g $cm^{-2}$.

The felts were stacked with their axes of alignment parallel, the stack was built up to a height of 2.4 cm and placed in a mould measuring 5.5 cm × 6.5 cm so that a catchment volume measuring approximately 36 × 2.4 cms was left unoccupied at the sides of the mould in the way illustrated in FIG. 6.

The mould and contents were heated to 340°C. A charge of molten aluminium alloy (20 $cms^3$ of HD 543 made by High Duty Alloys Ltd) superheated to 830°C was poured into the catchment volume between the stack of fibre arrays and the mould side and the mould closure platen was quickly actuated to press the admixture of fibre and metal according to the encapsulation pressure programme described in Example 1. The compression ratio was about 1:3 and the height of the resulting composite was 0.7 cms. The molten metal was found to have penetrated easily the fibre arrays from the catchment volume and to have totally encapsulated all the fibres composing each array by penetration from reservoir positions between each array. The resulting composite had the theoretical density of 2.83 $g/cm^3$ corresponding to an aluminium alloy (density 2.74 $g/cm^3$) containing 21% by volume of silicon carbide whiskers.

The composite was cut into test samples and the ultimate tensile strength (UTS) of the composite in the direction of the reinforcing fibre alignment, normal to this direction and at intermediate position was measured. The maximum UTS was found, as expected, in the fibre alignment direction and was the remarkably high value of 60 tons per square inch. The UTS dropped progressively with increasing angle to the alignment direction but, even in the weakest direction — normal to the alignment direction — possessed the high value of 28–30 tons per square inch. The magnitude of the improvement with this relatively low fibre volume is apparent from the UTS of a control sample of the aluminium alloy (HD543) without reinforcement which gave a yield stress value of 12 tons per square inch and UTS of 15–18 tons per square inch.

EXAMPLE 3

Aligned sheets of fibres (containing 80% by weight of 100 B.S.S. Mesh atomised aluminium powder and 20% of silicon carbide whiskers having a mean aspect ratio of 50:1) were formed by the process described in U.S. Pat. No. 3,617,437. The aligned sheets were cut to make a good fit within the mould shown diagrammatically in FIGS. 10 and 10*a*.

Referring to FIG. 10, horizontal aligned sheets 90 formed in a stack from particulate aluminium containing fibre arrays are enclosed within mould walls 91. Die closure 92 is arranged to apply the encapsulation pressure programme detailed in U.S. Pat. No. 3,695,335 after the stack has been preheated to 710°C to melt the aluminium particles, and inserted into the mould. The resulting composite was found to be substantially void-free and of theoretical density.

FIG. 10*a* illustrates a scrap view of a typical part of the stack of aligned fibre-arrays in which matrix metal particles 93 are shown dispersed within a fibre array 94. Array 94 is situated between similar adjacent layers 95 and 96 in which the alignment direction is coplanar with, but normal to, the alignment direction of array 94.

We claim:

1. A process for forming a composite material comprising a metal matrix incorporating non-metallic fibrous reinforcement having a predetermined pattern of fiber orientation which includes the steps of:

a. providing in a mold a plurality of layers of fibers formed from at least one array of substantially coplanar fibers, b. providing reservoirs of molten matrix metal between at least some of the layers of fibers, and c. forcing said molten metal to penetrate said layers and intimately to surround substantially each of the fibers by applying pressure to the mold contents, sufficient matrix metal reservoirs being provided for the separation between neighboring reservoirs to be within twice the distance that the molten metal can penetrate before solidification under the applied temperature and pressure.

2. A process according to claim 1 wherein the coplanar fibers in any fiber array are unidirectionally aligned.

3. A process according to claim 1 and in which the matrix metal reservoirs are formed in situ by melting solid phase matrix metal previously positioned between at least some of the layers of fibers.

4. A process according to claim 3 and in which the solid matrix metal is melted to form the matrix metal reservoirs before the fiber arrays and molten matrix metal are introduced into the mold.

5. A process according to claim 3 and in which the solid matrix metal is melted within the mold.

6. A process according to claim 3 wherein the solid matrix metal is provided in the form of sheets of matrix metal inserted between and parallel to the layers of fibers.

7. A process according to claim 6 and in which the layers of fibers are constituted by a roll formed from an array of aligned fibers, and the solid matrix metal is provided in the form of one or more sheets of solid matrix metal interposed within the roll.

8. A process according to claim 3 wherein the solid matrix metal is provided in the form of matrix metal particles dispersed throughout each fiber array.

9. A process according to claim 8 wherein the matrix metal particles are equant, substantially spherical, particles.

10. A process according to claim 8 wherein the mean particle size is at least 60 microns.

11. A process according to claim 1 and in which said molten metal reservoirs are provided in desired positions by forcing molten metal to flow, under the initial application of pressure to the mold contents, along paths of low flow resistance between the layers of fibers to said positions.

12. A process according to claim 11 and in which the layers of fibers are preconsolidated to improve their packing.

13. A process according to claim 11 and in which the molten matrix metal, is poured on to substantially parallel layers of fibers arranged in the mold transverse to the direction of approach of the mold closure and incompletely filling the transverse cross section of the molds so that a catchment volume substantially free of fibers is formed in the mold from which molten metal may flow directly between the layers of fibers to the desired reservoir positions without passing through the layers of fibers.

14. A process according to claim 13 wherein the catchment volume in the mold for molten matrix metal represents a fraction of the total volume of the mold prior to compression which approximates to the compression ratio to be applied to fully consolidate the fiber arrays and molten metal into a composite material.

15. A process according to claim 13 and in which the layers of fibers are preconsolidated to improve their packing.

16. A process according to claim 13 and in which a cylinder of composite material is formed by arranging a stack of annular layers of fibers in the mold to provide an axial catchment volume in the center of the stack, pouring the molten matrix metal into the catchment volume and pressing the layer of fibers and molten matrix metal to force the metal between the annular layer of fibers and thence around the fibers in each layer.

17. A process according to claim 1 in which the layers of fibers are formed from a rolled array of fibers and are forced into the mold which already contains molten matrix metal.

18. A process according to claim 1 and in which the fibres are selected from the group consisting of carbon and boron fibers in semi-continuous or staple form, glass, silica, asbestos and whiskers of silicon carbide, silicon nitride and alumina.

19. A process according to claim 1 and in which the matrix metal is selected from the group consisting of aluminum, magnesium, titanium, copper, nickel, lead, tin and alloys containing at least one of these metals.

20. A process according to claim 9 and in which the matrix metal is selected from the group consisting of aluminum, magnesium, titanium and alloys containing at least one of these metals.

21. A process according to claim 20 and in which the fibers are selected from the group consisting of boron fibers in staple or continuous form and whiskers of silicon carbide, silicon nitride and alumina.

22. A process according to claim 1 and in which the said parallel layers of fibers are arranged in the mold parallel to the direction of approach of the mold closure.

* * * * *